US010293903B2

(12) United States Patent
Fitzpatrick

(10) Patent No.: US 10,293,903 B2
(45) Date of Patent: May 21, 2019

(54) BOAT PROPELLER GUARD

(71) Applicant: Manatee Saver, LLC, Boyne Falls, MI (US)

(72) Inventor: William Fitzpatrick, Boyne Falls, MI (US)

(73) Assignee: Manatee Saver, LLC, Boyne Falls, MI (US)

( * ) Notice: Subject to any disclaimer, the term of this patent is extended or adjusted under 35 U.S.C. 154(b) by 156 days.

(21) Appl. No.: 15/599,102

(22) Filed: May 18, 2017

(65) Prior Publication Data

US 2017/0341721 A1 Nov. 30, 2017

Related U.S. Application Data

(60) Provisional application No. 62/341,353, filed on May 25, 2016.

(51) Int. Cl.
*B63H 5/00* (2006.01)
*B63H 5/16* (2006.01)

(52) U.S. Cl.
CPC ..... *B63H 5/165* (2013.01)

(58) Field of Classification Search
CPC ..... B63H 5/165
See application file for complete search history.

(56) References Cited

U.S. PATENT DOCUMENTS 2,213,610 A * 9/1940 Ronning ..... B63H 5/10 416/124
2,362,323 A * 11/1944 Stoppel ..... B63H 5/165 114/145 A
2,706,960 A * 4/1955 Crew ..... B63H 5/165 416/247 A
4,565,533 A * 1/1986 Springer ..... B63H 5/165 416/247 A
4,680,017 A * 7/1987 Eller ..... B63H 5/165 415/121.2
4,902,255 A * 2/1990 Faunda ..... B63H 5/165 416/247 A
4,932,839 A * 6/1990 Pitchford ..... B60V 1/14 416/246
4,944,702 A * 7/1990 Cain ..... B63H 20/007 440/51

(Continued)

*Primary Examiner* — Hieu T Vo
*Assistant Examiner* — Sherman D Manley
(74) *Attorney, Agent, or Firm* — Marshall & Melhorn, LLC

(57) ABSTRACT

What is provided is a propeller guard apparatus that may be readily configured to a variety of different boat motors. Described embodiments of the propeller guard apparatus comprise a cylindrical housing configured to circumferentially enclose a propeller from all sides in order to protect humans, pets, and aquatic wildlife from being entangled or cut by the propeller. Described embodiments of the propeller guard apparatus also comprise a protective structure, such as a skid plate comprising of at least two pieces of metal attached from the cylindrical housing to an end of the outer casing to form a folded T-shaped configuration. This type of configuration serves to protect the propeller from damage caused by submerged objects and aquatic wildlife found in shallow water. Also, the folded T-shaped configuration may push vegetation, weeds, manatees, and other aquatic wildlife away from the path of the moving boat and its propeller.

18 Claims, 6 Drawing Sheets

(56) References Cited

U.S. PATENT DOCUMENTS 4,957,459 A * 9/1990 Snyder ..... B63H 5/165 416/247 A
5,009,620 A * 4/1991 Feranda, Sr. ..... B63H 5/165 416/247 A
5,176,550 A * 1/1993 Hooper ..... B63H 5/165 416/247 A
5,178,565 A * 1/1993 Jacobson ..... B63H 5/165 416/247 A
5,389,021 A 2/1995 Padgett
5,399,113 A * 3/1995 DeMasi ..... B63H 20/10 440/65
5,470,262 A * 11/1995 Bustillo, Sr. ..... B63H 5/165 440/67
5,759,075 A * 6/1998 Steep ..... B63H 5/165 440/72
5,890,937 A * 4/1999 Granger ..... B63H 5/14 440/67
5,906,522 A * 5/1999 Hooper ..... B63H 20/34 416/247 A
5,928,042 A * 7/1999 Quiggins ..... B63H 5/165 416/247 A
6,478,640 B1 * 11/2002 Raps ..... B63H 5/165 440/72
6,503,110 B2 * 1/2003 Lammli ..... B63H 5/165 416/247 A
6,966,806 B1 * 11/2005 Bruestle ..... B63H 20/34 440/76
7,140,931 B2 * 11/2006 Norman ..... B63H 5/14 440/67
7,435,147 B1 * 10/2008 Eichinger ..... B63B 3/38 114/127
7,854,637 B2 * 12/2010 Schultz ..... B63H 5/14 440/67
8,257,121 B2 9/2012 Taylor
8,961,249 B2 * 2/2015 Stearn ..... B63H 5/165 440/66
2015/0329188 A1 * 11/2015 Downs ..... B63H 5/15 114/271

* cited by examiner

BOAT PROPELLER GUARD

PRIORITY CLAIM

This patent application is a Non-Provisional patent application and claims priority under 35 U.S.C. 119(e) to U.S. Provisional Patent Application Ser. No. 62/341,353, titled "BOAT PROPELLER GUARD," filed May 25, 2016. The entire disclosure of the aforementioned patent application is incorporated by reference as if fully stated herein.

FIELD

This patent application relates to a boat propeller guard apparatus for improving the safety of humans and animals and for protecting aquatic wildlife.

BACKGROUND

Numerous injuries and deaths occur each year when people and animals unintentionally contact an operating boat motor propeller. Due to its position on a motorized boat and the fact that a boat motor propeller spins at a very high RPM during use, it often poses a significant safety risk to any person or animal in proximity to the propeller. For example, spinning boat motor propellers have caused serious injuries to boat passengers, water skiers, swimmers, scuba divers, and aquatic wildlife, such as manatees. Manatees are particularly susceptible since they spend a large portion of the day swimming in shallow waters.

Even though there are several boat motor propeller guards, cages, and/or shields designed to reduce the number of accidents and injuries caused by rotating propellers, they often don't address other serious safety problems to people, the aquatic wildlife, and to the propellers, themselves. Some boat motor propeller guards increase the frequency of blunt force trauma to people and aquatic wildlife due to their larger size and specific shape. Despite limiting the harm caused by propeller blade lacerations, many conventional propeller guards often cause blunt force trauma to people and aquatic wildlife swimming below the guards due to the keel or skeg projecting below the propeller.

In other instances, some conventional propeller guards merely comprise ring-like structures that do not fully encapsulate the propellers from all sides. As a result, rocks, weeds, fishing lines, and other debris may become entangled within the propeller, which cause damage to the propeller and impede the function of the boat. Even if no damage is caused to the propeller, the entanglement is likely to cause drag that will slow the boat and limit its range of operation. Propeller guards that have attempted to solve this problem require the use of bulky, permanent structures and additions that may not be easily removed or modified in a boat.

Accordingly, there is a need for an apparatus that protects people, animals, aquatic and plant wildlife from inadvertently contacting a moving boat propeller, while simultaneously preventing blunt force trauma related impacts caused by a moving boat. Beneficially, such an apparatus would be easily attached to and removed from conventional boat motors.

SUMMARY

What is provided is a propeller guard apparatus that may be readily configured to a variety of different boat motors. The propeller guard may be provided pre-attached to a boat or provided separately from the boat and then physically attached to the boat at a later time. The propeller guard may be easily attached to and removed from the boat as desired by its user.

In some embodiments of the present invention, the boat propeller guard apparatus comprises a cylindrical housing configured to circumferentially and fully enclose a propeller; an outer casing attached to the propeller and the cylindrical housing; a protective structure attached at one end to the cylindrical housing and at another end to the outer casing, the attachment to the outer casing is opposite from the propeller; and an impact restraint coupled to the outside of the protective structure through an attachment mechanism, the impact restraint is substantially parallel to the protective structure. The circumferential enclosing of the propeller by the cylindrical housing helps protect swimmers, water skiers, scuba divers, pets, and aquatic wildlife from encountering or being entangled by the propeller.

In another embodiment of the present invention, the boat propeller guard comprises a cylindrical housing configured to circumferentially enclose a propeller, the cylindrical housing comprises a plurality of holes on the outer surface of the cylindrical housing; an outer casing attached to the propeller and the cylindrical housing; a protective structure attached at one end to the cylindrical housing and at another end to the outer casing, the attachment to the outer casing is opposite from the propeller; and an impact restraint coupled to the outside of the protective structure through an attachment mechanism, the impact restraint is substantially parallel to the protective structure.

In some embodiments, the skid plate comprises of at least two pieces of metal attached from the cylindrical housing to an end of the outer casing to form a folded T-shaped configuration. This type of configuration provides structural support to the skeg and the boat by completely encapsulating the skeg. In addition, the skid plate serves to protect the skeg and propeller from damage caused by rocks, logs, stumps, weeds, fishing lines, gill nets, and other submerged objects and/or aquatic wildlife that may be encountered in shallow water. The attachment of the skid plate to the outer casing may form a folded T-shaped configuration in order to push vegetation, weeds, debris, and other aquatic wildlife away from the path of the moving boat and its propeller, instead of merely plowing straight through the aquatic wildlife and vegetation and cutting the same. The outer casing is attached to an impact restraint using with the use of springs in order to absorb and transfer the shock experiences by any impact of the propeller guard apparatus with a thing or object.

Described embodiments of the propeller guard apparatus also include a screen configured to allow the substantially free flow of water while preventing objects such as vegetation, marine, and human life from coming in contact with the propeller and boat motor. The screen may comprise of a thick, durable material that provides strength and stability. In addition, the screen may comprise flexible, elongated members, such as strings or mesh formed from metals, plastics, or composites. In some embodiments, the elongated members of the screen may be arranged in a crisscrossed pattern.

BRIEF DESCRIPTION OF THE DRAWINGS

Subject matter is particularly pointed out and distinctly claimed in the concluding portion of the specification. Claimed subject matter, however, as to structure, organization and method of operation, together with objects, features, and advantages thereof, may best be understood by reference to the following detailed description if read with the accompanying drawings in which:

DETAILED DESCRIPTION

Throughout this specification, reference to "one embodiment," "an embodiment," or similar language means that a particular feature, structure, or characteristic described in connection with the embodiment is included in at least on embodiment of the present invention. Thus, the phrases "one embodiment," "an embodiment," or similar language throughout this specification may, but does not necessarily all refer to the same embodiment.

In the following detailed description, numerous specific details are set forth in order to provide a thorough understanding of the examples as defined in the claimed subject matter, and as an example of how to make and use the examples described herein. However, it will be understood by those skilled in the art that claimed subject matter is not intended to be limited to such specific details, and may even be practiced without requiring such specific details. In other instances, well-known methods, procedures, and components have not been described in detail so as not to obscure the examples defined by the claimed subject matter.

As used herein, the terms "folded T-shape configuration" and "substantially folded T-shape configuration" refer to a configuration in which one piece of metal is folded over another piece of metal to form a T-shape.

Figure 1:
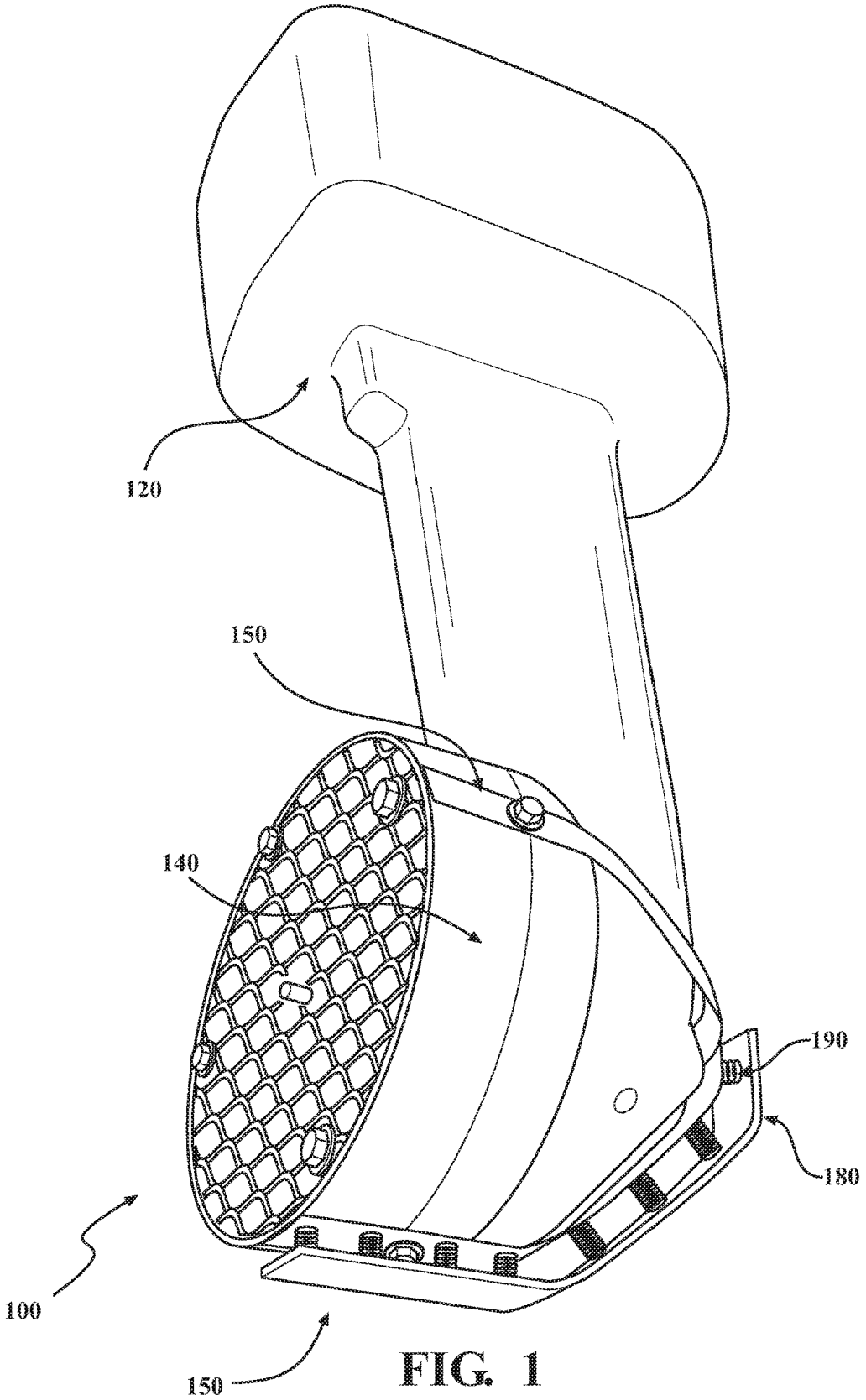
FIG. 1 is an exemplary embodiment of a perspective view of a propeller guard apparatus connected to a boat motor.

Referring to FIG. 1, FIG. 1 shows an exemplary embodiment of perspective view of a propeller guard apparatus 100 attached to a boat motor 120. The propeller guard apparatus 100 can be attached to any suitable type of boat. Examples of suitable types of boats include, but are not limited to, boats that have one or more outboard motors, boats that have one or more inboard/outboard motors, and boats that have one or more propellers. The propeller guard 100 can be sold pre-attached to a boat or separate from the boat and then physically attached to the boat at a later time.

The propeller guard apparatus 100 comprises a cylindrical housing 140 configured to circumferentially and fully enclose a propeller 130 (shown in FIGS. 4 and 5) from all sides. Instead of enclosing the propeller 130 with a mere ring-like structure that contains large openings on various sides of the propeller 130, the cylindrical housing 140 may completely circumferentially enclose the propeller 130. The complete circumferential enclosing of the propeller 130 by the cylindrical housing 140 helps protect swimmers, water skiers, scuba divers, pets, and aquatic wildlife from encountering or being entangled by the propeller 130.

The propeller guard apparatus 100 also comprises a protective/support structure, such as a skid plate 150. In some embodiments, the skid plate 150 comprises of at least two pieces of metal attached from the cylindrical housing 140 to an end of the outer casing 170. The assembly and attachment of the skid plate 150 to the boat provides structural support to the skeg by completely encapsulating the skeg so that it is no longer exposed. As a result, assembly and attachment of the skid plate 150 also provides structural support to the rest of the boat. In addition, the skid plate 150 serves to protect the skeg and propeller from damage caused by rocks, logs, stumps, weeds, fishing lines, gill nets, and other submerged objects and/or aquatic wildlife that may be encountered in shallow water. Instead of impacting these objects, the skid plate 150 may glide over the top of a submerged object and/or aquatic wildlife, such as manatees, without damaging the components of the boat or without harming the submerged object, the aquatic wildlife, or people. In addition, the skid plate 150 can minimize resistance or interference with the steering operations of the boat motor 120.

The skid plate 150 is attached to an impact restraint 180 along the bottom and back of the skid plate 150 (on opposite side of the propeller) through an attachment mechanism, such as springs 190, shocks, rubber, plastics, and the like. The impact restraint 180 extends longitudinally up the back of the boat comprising the propeller guard apparatus 100. In some embodiments, the impact restraint 180 is a shock absorber that may be constructed from materials, such as steel, polymer, carbon fiber, fiberglass, rubber, plastic, and aluminum. The width of the impact restraint 180 varies. In some embodiments, the width of the impact restraint 180 is between about 1.5 inches to about 4 inches.

The springs 190 may be readily replaced/interchanged from the skid plate 150 depending on the operator's desired location and frequency of the springs 190. As such, the number and location of springs 190 connecting the skid plate with the impact restraint 180 may vary. In some embodiments, the springs 190 are welded to the skid plate 150 and the impact restraint 180. The impact restraint 180 is meant to absorb and transfer any shock received from the impact of the propeller guard apparatus 100 with a thing or object. The shock is transferred in such a way that it protects both the object that was hit and the boat motor.

The propeller guard apparatus 100 may be formed of any material that allows the propeller guard apparatus 100 to function as intended in an aquatic environment. In some embodiments, the propeller guard apparatus 100 can comprise one or more materials, including, but not limited to light-weight metallic based material, such as steel alloys, aluminum alloys, titanium alloys, or the like. Also, the propeller guard apparatus 100 may be formed of composite materials including carbon fiber, fiberglass, or high-impact plastics. Depending on the type of material used, the propeller guard apparatus 100 may be pressed, injection molded, rotation molded, spun, extruded, or rolled to form a protective layer.

Figure 2:
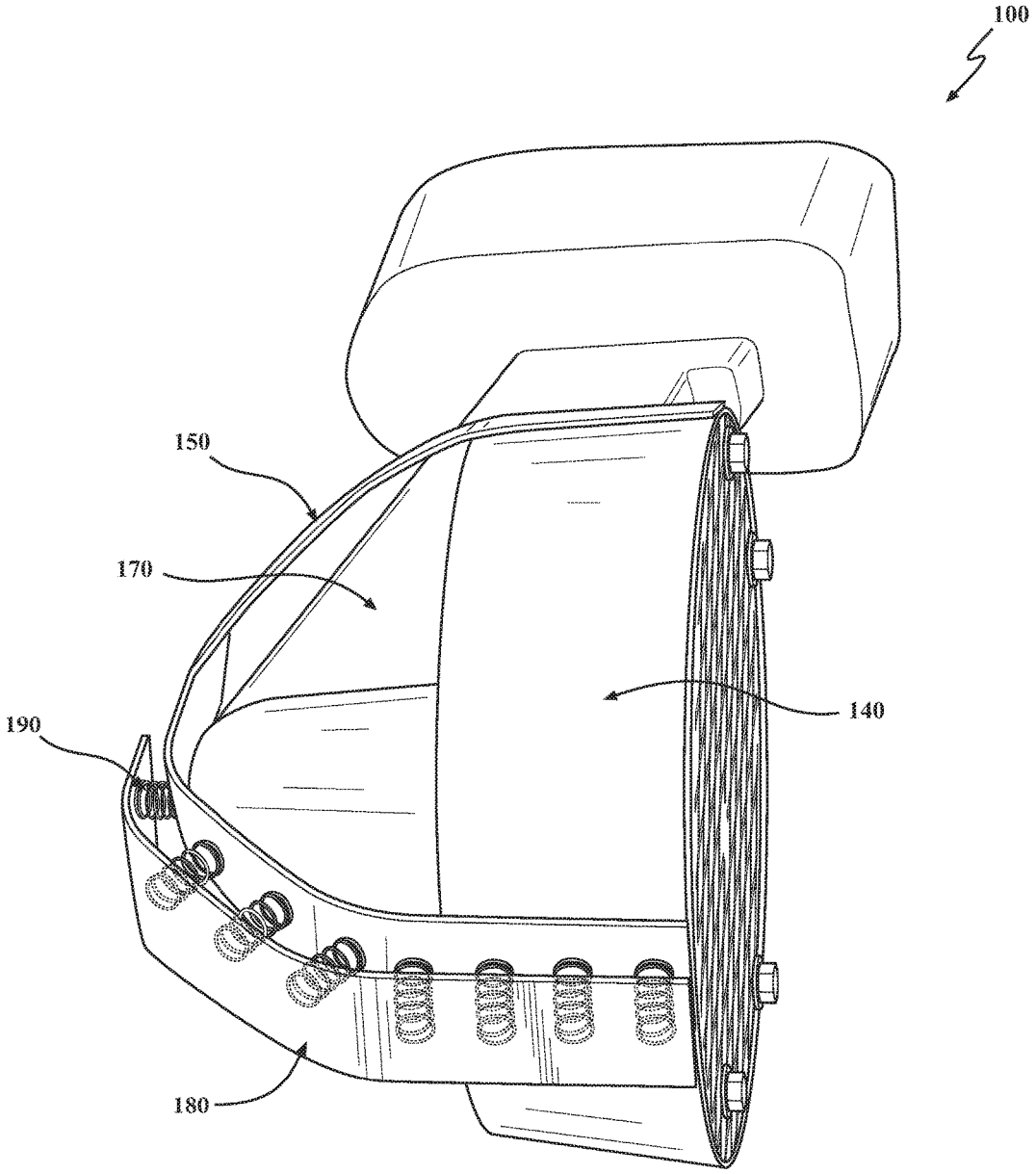
FIG. 2 is an exemplary embodiment of a side perspective view of the propeller guard apparatus connected to the boat motor.
Figure 4:
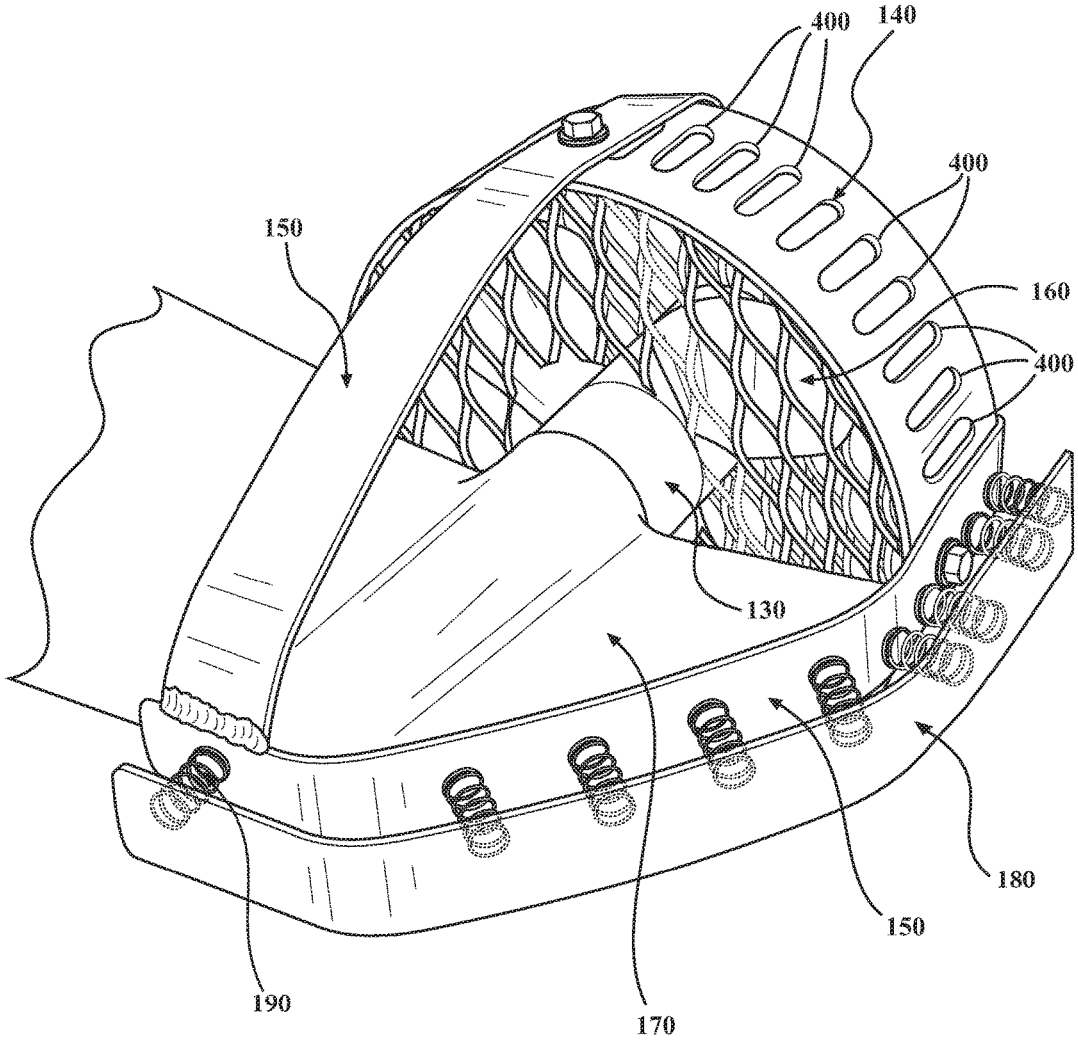
FIG. 4 is another exemplary embodiment of a back perspective view of the propeller guard apparatus connected to the boat motor.
Figure 5:
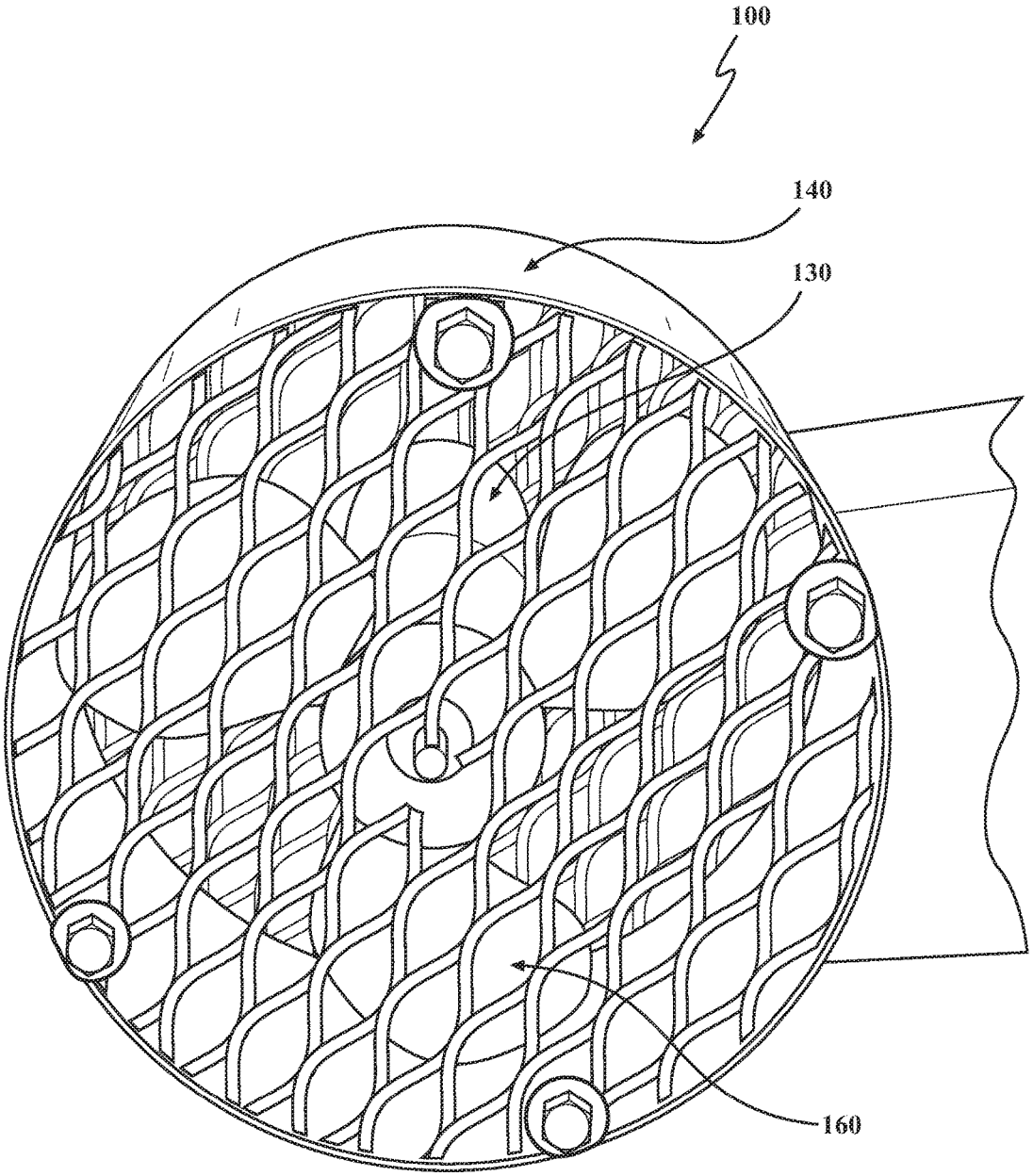
FIG. 5 is an exemplary embodiment of a perspective view of the propeller guard apparatus having a screen.

Referring to FIG. 2, FIG. 2 shows an exemplary embodiment of a side perspective view of the propeller guard apparatus 100 connected to the boat motor 120. The propeller guard apparatus 100 may be any suitable size that allows it to fulfill its intended purposes. In some embodiments, the propeller guard apparatus 100 is sized to be substantially equal in size or larger than the circumference of the lateral-most edges of the propeller 130 when the propeller 130 (as shown in FIGS. 4 and 5) is spinning. The propeller guard apparatus 100 helps prevents objects from damaging, or being damaged by, the sharp edges of the propeller 130.

In situations where the boat encounters aquatic wildlife, such as a manatee, the propeller guard apparatus 100 will help reduce the potential harm to both the manatee and the boat. In addition to shielding the blades of the propeller 130 from unintentional contact with the manatee, the skid plate 150 on the propeller guard apparatus 100 provides a rounded, smooth surface with no sharp corners or edges that may lacerate the manatee. Due to the specific design of the skid plate 150, the skid plate 150 has rounded and smooth edges that allow a manatee to be deflected away from the boat in a manner that does not cause blunt force trauma or other permanent damage to the manatee.

The propeller guard apparatus 100 may be easily attached to and removed from the boat motor 120 through a variety of techniques, including sliding clamps, clips, standard nuts and bolts, such as cap head bolts, adhesives, rubber attachments, and the like. In some embodiments, smooth cap head bolts can be used to readily attach and detach the propeller guard apparatus 100 from the boat motor 120. Consequently, there is no need to drill permanent holes into portions of the boat surrounding the propeller 130 or to use other permanent techniques, such as welding and other functionally similar fastening means.

Figure 3:
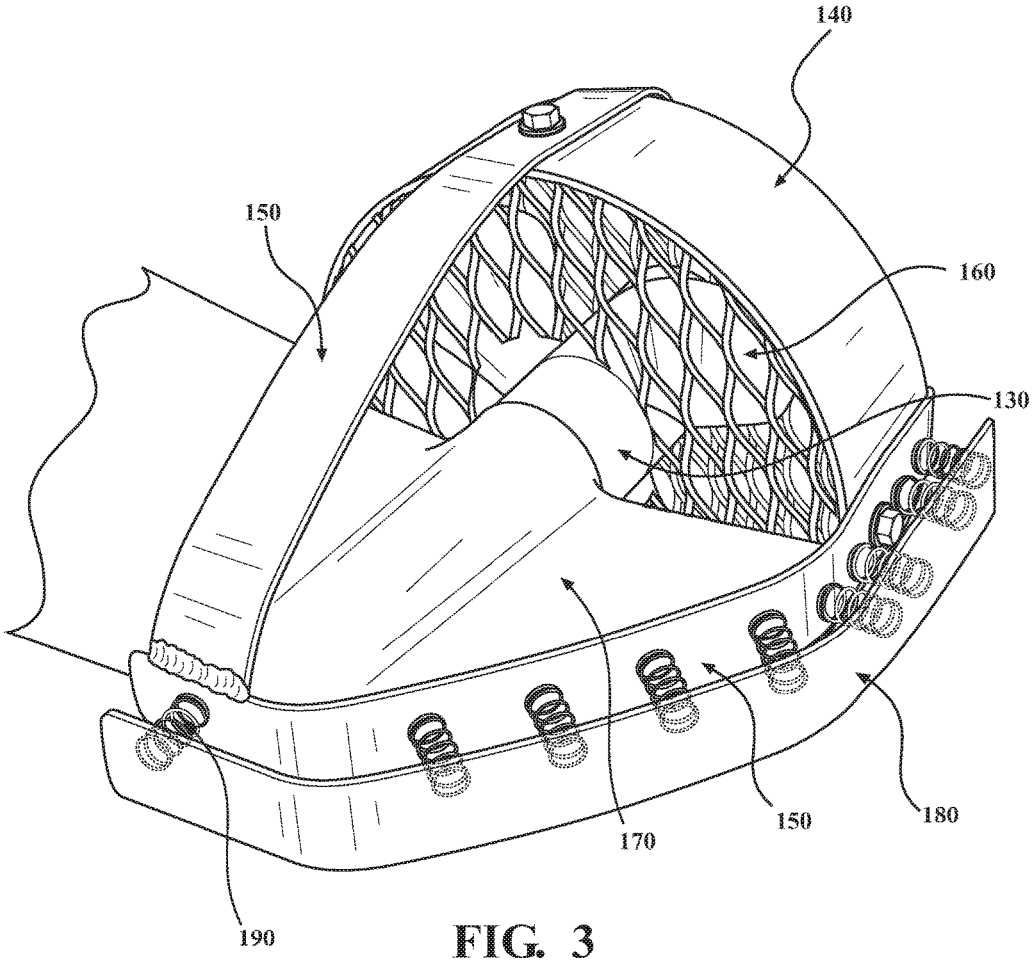
FIG. 3 is an exemplary embodiment of a back perspective view of the propeller guard apparatus connected to the boat motor.

Referring to FIG. 3, FIG. 3 shows an exemplary embodiment of a back perspective view of the propeller guard apparatus 100 connected to the boat motor 120. The skid plate 150 and the outer casing 170 assembly form a folded T-shaped configuration. This T-shaped configuration forms a rounded, smooth end that does not come to a point. Due to this configuration, the propeller guard apparatus 100 helps limit the amount of vegetation and aquatic wildlife that gets pushed into the propeller 130 and potentially causes damage to both the propeller 130 and the boat. The impact restraint 180 attaches to the folded T-shaped configuration using the springs 190 to absorb and transfer the shock experienced by any impact of the propeller guard apparatus 100 with a thing or object.

Referring to FIG. 4, FIG. 4 shows another exemplary embodiment of a back perspective view of the propeller guard apparatus 100 connected to the boat motor 120. In this embodiment, the cylindrical housing 140 comprises holes 400, such as vertical slits or elongated drill holes to allow a greater amount water to pass into and out of the area within the cylindrical housing 140 surrounding the propeller 130. The holes 300 may be angled in the same direction as the rotation of the propeller 130. Each hole 300 has a width of at least about ⅛ of an inch. The number, frequency, and arrangement of the holes 300 varies depending on the need of the operator of the propeller guard apparatus 100. The holes 300 allow water to flow in and out of the cylindrical housing 140 to prevent significant buildup of water in the cylindrical housing 140 at any one time. Such buildup of water may cause obstruction and/or limit the thrust power of the propeller guard apparatus 100.

In some embodiments, a casing screen (not shown), such as, but not limited to a mesh screen, may be placed over the holes 400 to prevent unwanted debris, aquatic wildlife, or objects from entering into the holes 400 and potentially damaging the propeller 130. Examples of some of these objects may be fishing hooks, boat/vessel components, and the like.

Referring to FIG. 5, FIG. 5 shows an exemplary embodiment of a perspective view of the propeller guard apparatus 100 having a screen 160. The screen 160 is configured to allow the substantially free flow of water while preventing objects such as vegetation, marine, and human life from coming in contact with the propeller 130 and boat motor 120. The screen 160 may comprise flexible, elongated members, such as strings or mesh formed from metals, plastics, or composites. In some embodiments, the elongated members of the screen 160 may be arranged in a crisscrossed pattern. In other embodiments, the elongated members of the screen 160 may be woven. The elongated members may be formed from any suitable technique, including welding, bolting and molding. The screen 160 may be formed of a variety of durable and strong materials, including stainless steel.

Figure 6:
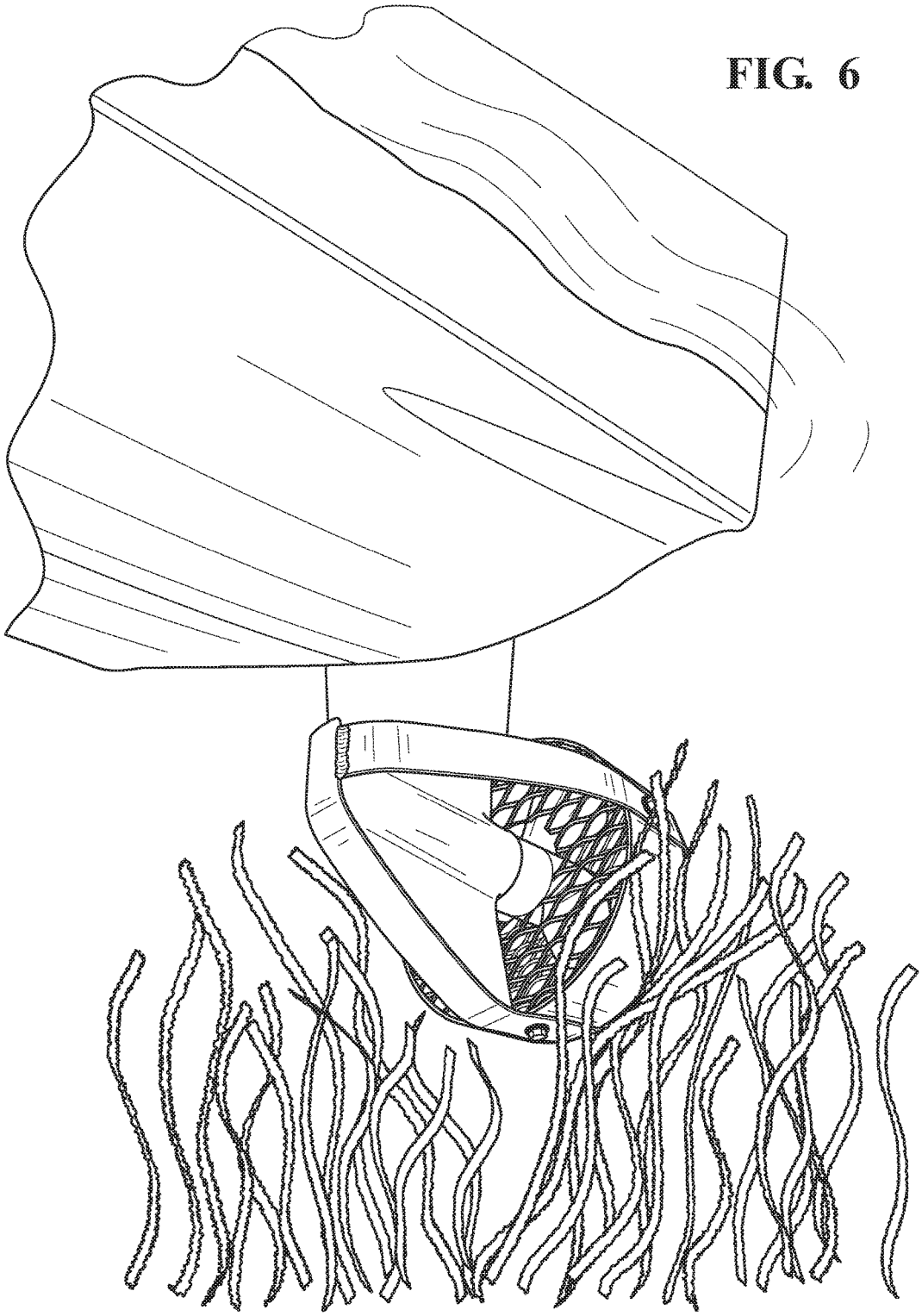
FIG. 6 is an exemplary embodiment of a perspective view of the propeller guard apparatus engaged in an aquatic environment.

Referring to FIG. 6, FIG. 6 shows an exemplary embodiment of a top perspective view of the propeller guard apparatus 100 engaged in an aquatic environment. The attachment of the skid plate 150 to the outer casing 170 may form a folded T-shaped configuration in order to push vegetation, weeds, debris, and other aquatic wildlife away from the path of the moving boat and its propeller 130, instead of merely plowing straight through the aquatic wildlife and vegetation and cutting the same. As a result, the propeller guard apparatus 100 disclosed herein helps protect aquatic indigenous species by limiting the amount of vegetation and aquatic wildlife that gets pushed into the propeller 130. The T-shaped configuration may help minimize the potential damage caused to aquatic wildlife, such as manatees, by pushing the aquatic wildlife down and away from the propeller guard apparatus 100 in a manner that prevents laceration and greatly reduces the blunt force trauma to the wildlife.

It will, of course, be understood that, although particular embodiments have just been described, the claimed subject matter is not limited in scope to a particular embodiment or implementation. Likewise, an embodiment may be implemented in any combination of systems, methods, or products made by a process, for example.

In other instances, features that would be understood by one of ordinary skill were omitted or simplified so as not to obscure claimed subject matter. While certain features have been illustrated or described herein, many modifications, substitutions, changes or equivalents will now occur to those skilled in the art. It is, therefore, to be understood that claims are intended to cover all such modifications or changes as fall within the true spirit of claimed subject matter.

The invention claimed is:

1. A boat propeller guard comprising:

a cylindrical housing configured to circumferentially and fully enclose all sides of a propeller;

an outer casing attached to the propeller and the cylindrical housing;

a protective structure attached at one end to the cylindrical housing and at another end to the outer casing, the attachment to the outer casing is opposite from the propeller; and an impact restraint coupled to the outside of the protective structure through an attachment mechanism, the impact restraint is substantially parallel to the protective structure, and wherein the attachment mechanism is selected from the group consisting of a spring, a shock, a piece of rubber, and a piece of plastic.

2. The boat propeller guard of claim 1, the protective structure is a skid plate configured to glide over the top of a submerged object or aquatic wildlife when the propeller is in motion.

3. The boat propeller guard of claim 2, the skid plate comprises a rounded, smooth surface.

4. The boat propeller guard of claim 1, the impact restraint is a shock absorber and is constructed from a material selected from the group consisting of steel, polymer, carbon fiber, fiberglass, rubber, plastic, and aluminum.

5. The boat propeller guard of claim 4, the shock absorber is configured to absorb and transfer the shock experienced by the boat propeller guard when the propeller is in motion.

6. The boat propeller guard of claim 1, the width of the impact restraint is between about 1.5 inches and 4 inches.

7. The boat propeller guard of claim 1, the protective structure is attached to the outer casing to form a substantially folded T-shape configuration.

8. The boat propeller guard of claim 7, the folded T-shape configuration comprises a round, smooth end.

9. The boat propeller guard of claim 1, the boat propeller guard further comprising a screen, the screen configured to allow a substantially free flow of water into and out of the propeller, while preventing objects from coming in contact with the propeller when the propeller is in motion.

10. The boat propeller guard of claim 9, the screen comprises flexible, elongated members.

11. The boat propeller guard of claim 10, the elongated members are strings or mesh.

12. A boat propeller guard comprising:

a cylindrical housing configured to circumferentially and fully enclose all sides of a propeller, the cylindrical housing comprises a plurality of holes on the outer surface of the cylindrical housing;

an outer casing attached to the propeller and the cylindrical housing;

a protective structure attached at one end to the cylindrical housing and at another end to the outer casing, the attachment to the outer casing is opposite from the propeller;

an impact restraint coupled to the outside of the protective structure through an attachment mechanism, the impact restraint is substantially parallel to the protective structure;

a first screen, the first screen configured to allow a substantially free flow of water into and out of the propeller, while preventing objects from coming in contact with the propeller when the propeller is in motion; and a second screen, the second screen is positioned around the outside of the holes.

13. The boat propeller guard of claim 12, the holes are each angled in the same direction as the rotation of the propeller when the propeller is in motion.

14. The boat propeller guard of claim 12, the protective structure is a skid plate configured to glide over the top of a submerged object or aquatic wildlife when the propeller is in motion.

15. The boat propeller guard of claim 14, the skid plate comprises a rounded, smooth surface.

16. The boat propeller guard of claim 12, the protective structure is attached to the outer casing to form a substantially folded T-shape configuration.

17. The boat propeller guard of claim 16, the folded T-shape configuration comprises a round, smooth end.

18. A boat propeller guard comprising:

a cylindrical housing configured to circumferentially and fully enclose all sides of a propeller;

an outer casing attached to the propeller and the cylindrical housing;

a protective structure attached at one end to the cylindrical housing and at another end to the outer casing, the attachment to the outer casing is opposite from the propeller;

an impact restraint coupled to the outside of the protective structure through an attachment mechanism, the impact restraint is substantially parallel to the protective structure; and a screen, the screen configured to allow a substantially free flow of water into and out of the propeller, while preventing objects from coming in contact with the propeller when the propeller is in motion, wherein the first screen comprises flexible, elongated members, and wherein the elongated members are strings or mesh.

* * * * *